US010030638B2

(12) United States Patent
Bagagli et al.

(10) Patent No.: US 10,030,638 B2
(45) Date of Patent: Jul. 24, 2018

(54) ELECTROMAGNETIC ACTUATOR FOR A RECIPROCATING COMPRESSOR

(71) Applicant: Nuovo Pignone Srl, Florence (IT)

(72) Inventors: Riccardo Bagagli, Florence (IT); Leonardo Tognarelli, Florence (IT)

(73) Assignee: Nuovo Pignone Srl, Florence (IT)

( * ) Notice: Subject to any disclaimer, the term of this patent is extended or adjusted under 35 U.S.C. 154(b) by 581 days.

(21) Appl. No.: 14/400,654

(22) PCT Filed: May 10, 2013

(86) PCT No.: PCT/EP2013/059709

§ 371 (c)(1),
(2) Date: Nov. 12, 2014

(87) PCT Pub. No.: WO2013/171125

PCT Pub. Date: Nov. 21, 2013

(65) Prior Publication Data

US 2015/0098849 A1 Apr. 9, 2015

(30) Foreign Application Priority Data

May 16, 2012 (IT) ..... CO2012A0028

(51) Int. Cl.
*F04B 3/00* (2006.01)
*F04B 5/02* (2006.01)
(Continued)

(52) U.S. Cl.
CPC ..... *F04B 3/00* (2013.01); *F04B 5/02* (2013.01); *F04B 35/045* (2013.01); *F04B 39/0022* (2013.01)

(58) Field of Classification Search
CPC ..... F04B 17/04; F04B 17/044; F04B 5/02; F04B 3/00; F04B 35/045; F15B 2201/21;
(Continued)

(56) References Cited

U.S. PATENT DOCUMENTS 1,978,866 A 10/1934 Konig
4,334,833 A 6/1982 Gozzi
(Continued)

FOREIGN PATENT DOCUMENTS

CN 1319173 A 10/2001
CN 1766332 A 5/2006
(Continued)

OTHER PUBLICATIONS

Unofficial English translation of Chinese Office Action issued in connection with corresponding CN Application No. 201380025391.6 dated Feb. 1, 2016.
(Continued)

*Primary Examiner* — Kenneth J Hansen
(74) *Attorney, Agent, or Firm* — GE Global Patent Operation

(57) ABSTRACT

A compressor including a pair of opposed pistons disposed in a housing and defining a compression chamber. An electromagnetic actuator reciprocatedly drives the pistons within the housing in cooperation with force accumulator. The force accumulators bank the force during a first reciprocation, decelerating the pistons, and apply the force in a subsequent reciprocation, thereby accelerating the pistons.

9 Claims, 4 Drawing Sheets

(51) Int. Cl.
*F04B 35/04* (2006.01)
*F04B 39/00* (2006.01)

(58) Field of Classification Search
CPC ... F15B 15/1447; F15B 15/226; F15B 15/228
USPC ..... 417/486–488, 521, 534
See application file for complete search history.

(56) References Cited

U.S. PATENT DOCUMENTS

| | | | | |
|---|---|---|---|---|
| 4,832,578 | A | 5/1989 | Putt | |
| 5,273,409 | A | 12/1993 | Swain | |
| 5,354,185 | A | 10/1994 | Morinigo et al. | |
| 5,636,601 | A | 6/1997 | Moriya et al. | |
| 6,079,960 | A * | 6/2000 | Funatsu | F04B 35/045 417/313 |
| 6,638,035 | B1 | 10/2003 | Puff | |
| 6,733,245 | B2 * | 5/2004 | Oh | F04B 35/045 417/211 |
| 6,746,211 | B2 | 6/2004 | Kwon et al. | |
| 6,753,665 | B2 | 6/2004 | Ueda et al. | |
| 6,793,470 | B2 | 9/2004 | Song et al. | |
| 7,213,683 | B2 | 5/2007 | Lilie et al. | |
| 7,316,547 | B2 | 1/2008 | Lilie et al. | |
| 7,459,868 | B2 | 12/2008 | Yoo et al. | |
| 7,516,940 | B2 | 4/2009 | Kopecek et al. | |
| 7,651,069 | B2 | 1/2010 | Kopecek et al. | |
| 2002/0155012 | A1 | 10/2002 | Zabar | |
| 2003/0072658 | A1 | 4/2003 | Park et al. | |
| 2003/0077192 | A1 * | 4/2003 | Shin | F04B 35/045 417/488 |
| 2003/0218854 | A1 | 11/2003 | Kopecek et al. | |
| 2004/0211628 | A1 | 10/2004 | Kojima et al. | |
| 2004/0265155 | A1 | 12/2004 | Hunter et al. | |
| 2006/0127250 | A1 | 6/2006 | Park et al. | |
| 2007/0095073 | A1 | 5/2007 | Tian et al. | |
| 2009/0047154 | A1 | 2/2009 | Choi et al. | |
| 2009/0191073 | A1 | 7/2009 | Kopecek et al. | |
| 2009/0250644 | A1 | 10/2009 | Kopecek et al. | |
| 2009/0304525 | A1 | 12/2009 | Reinschke | |
| 2010/0162733 | A1 | 7/2010 | Hannig et al. | |
| 2011/0058968 | A1 | 3/2011 | Kang et al. | |
| 2011/0318193 | A1 | 12/2011 | Hu et al. | |
| 2012/0034119 | A1 | 2/2012 | Du | |

FOREIGN PATENT DOCUMENTS

| | | | |
|---|---|---|---|
| FR | 2129746 | A5 | 10/1972 |
| GB | 837312 | A | 6/1960 |
| GB | 1323859 | A | 7/1973 |
| GB | 2125223 | A | 2/1984 |
| JP | S5613558 | U | 2/1981 |
| JP | S57186668 | U | 11/1982 |
| JP | S59133784 | U | 9/1984 |
| JP | H06174321 | A | 6/1994 |
| JP | H07280372 | A | 10/1995 |
| JP | H11324912 | A | 11/1999 |
| JP | 2000130325 | A | 5/2000 |
| JP | 2001333569 | A | 11/2001 |
| JP | 2002195674 | A | 7/2002 |
| JP | 2003148339 | A | 5/2003 |
| JP | 2004003408 | A | 1/2004 |
| JP | 2004124896 | A | 4/2004 |
| JP | 2004140902 | A | 5/2004 |
| JP | 2004353563 | A | 12/2004 |
| JP | 2006070734 | A | 3/2006 |
| JP | 2006207472 | A | 8/2006 |
| JP | 2012246982 | A | 12/2012 |
| SU | 1608360 | A1 | 11/1990 |
| SU | 1682627 | A1 | 10/1991 |
| WO | 9631937 | A1 | 10/1996 |
| WO | 0017585 | A1 | 3/2000 |

OTHER PUBLICATIONS

Italian Search Report and Written Opinion issued in connection with related IT Application No. CO2012A000027 dated Jan. 8, 2013.
PCT Search Report and Written Opinion issued in connection with related PCT Application No. PCT/EP13/059710 dated Jun. 9, 2015.
Deffenbaugh et al., "Advanced Reciprocating Compression Technology (ARCT)", Southwest Research Institute, pp. 97-107, Dec. 2005.
Italian Search Report issued in connection with corresponding Italian application CO2012A000028 dated Feb. 4, 2013.
Russian Office Action issued in connection with corresponding RU Application No. 2014144231 dated Dec. 27, 2016.
U.S. Non-Final Office Action issued in connection with related U.S. Appl. No. 14/401,320 dated Dec. 12, 2016.
Russian Search Report issued in connection with corresponding RU Application No. 2014144649 dated Dec. 15, 2016.
Unofficial English translation of Office Action issued in connection with corresponding JP Application No. 2015512001 dated Feb. 14, 2017.
Unofficial English translation of Office Action issued in connection with corresponding JP Application No. 2015512002 dated Feb. 14, 2017.
Unofficial English Translation of Chinese Notice of Allowance issued in connection with corresponding CN Application No. 201380025391.6 dated Mar. 30, 2017.
Riccardo Bagagli et al., U.S. Appl. No. 14/401,320, filed Nov. 14, 2014.

* cited by examiner

ELECTROMAGNETIC ACTUATOR FOR A RECIPROCATING COMPRESSOR

BACKGROUND OF THE INVENTION

The subject matter disclosed herein relates generally to compressors. More particularly, the subject matter disclosed herein relates to electromagnetically driven reciprocating compressors adapted for use in displacing fluids, such as oil or natural gas.

Reciprocating compressors are widely used in the oil and gas industry to pressurize and displace gas. For example, in gas pipeline transmission systems and distribution networks, reciprocating compressors move natural gas from production sites to end-users by ingesting relatively low pressure gas, and expelling the gas at a higher pressure. Reciprocating compressors also perform this same function used in industrial plants, such as petroleum refineries and chemical plants, where compressors move intermediate and end product gases.

Reciprocating compressors typically include a piston driven by a rotatory motor, such as an internal combustion engine or motor. In such systems, a crankshaft and connecting rod convert motor shaft rotation to piston translation in a compression chamber. Piston translation within a cylinder bore in turn compresses gas in a compression chamber located at an end of the cylinder bore. Such machines may be single action, where gas compression takes place only when the piston moves in a single direction, or double action, where gas compression takes place when the piston moves in two directions.

Rotary reciprocating compressors have several disadvantages.

First, during the majority of each rotation of the motor shaft, the connecting rod applies force to the piston at an angle with respect to the piston translation axis.

Since the crankshaft is mechanically linked piston, piston travel during each stroke is fixed. Therefore, the volume swept by the piston during a stroke is also fixed. This means that the, in order to change the volume of gas pumped over time, operating speed must be changed. Operating speed change limits the flexibility of the machine insofar as pumping capacity as, in order to change the volume of gas pumped over time, the machine be sped up or slowed down, as would is necessary when gas demand in the distribution network increases or decreases. Changing operating speed is undesirable because it reduces efficiency and changes the vibration frequency imposed on the equipment.

One solution to these problems is an electromagnetically actuated reciprocating compressor. Such systems use linear motors attached to piston rods to drive opposed pistons in a single compression chamber. When the pistons move in phase with a 0 degree offset, thereby maintaining a fixed distance between the opposed pistons, the compression chamber volume remains constant, and reciprocation effects minimal gas displacement (or gas compression). When the pistons move out of phase with a 180 degree offset, thereby minimizing compression chamber volume when the pistons reach top dead center, and minimizing compression chamber volume when the pistons reach bottom dead center, reciprocation alternately minimizes and maximizes volume to effect maximum gas displacement (or gas compression). Varying the phase angle between these two extremes therefore provides a means for varying displacement (and compression) from a minimum when the pistons move "in phase", and a maximum when the pistons move "out of phase".

Unfortunately, currently available linear motor technology is unsuitable for use in such phased compressors because the associated high inertial rod loads. Existing linear motors can generate a limited amount of force, and the inertia associated with piston rod/compression piston assemblies in machines suitable for use in natural gas systems exceeds that available from existing linear motors. In addition, oppositely arranged pistons in a standard reciprocating compressor would make the machine prohibitively large. And varying the phase between oppositely arranged pistons in a standard reciprocating compressor is not an easy or fast operation.

Accordingly, there is a need for an electromagnetic actuator for a piston rod where phasing control can be easily obtained by controlling current command on the electromagnetic motor. There is a further need for an electromagnetic actuator that allows for a compact machine. Finally, there is a need for an electromagnetic actuator that can overcome the high inertial forces associated with accelerating and decelerating a piston rod/compression piston assembly.

BRIEF DESCRIPTION OF THE INVENTION

Various other features, objects, and advantages of the invention will be made apparent to those skilled in the art from the accompanying drawings and detailed description thereof.

In one embodiment, a reciprocating compressor is provided. The reciprocating compressor comprises a housing having an inner surface defining compression chamber, the housing having a first aperture and a second aperture; a first piston having a compression face, the piston being slidably disposed within the compression chamber; a first piston rod having proximate portion and a distal portion, the proximate portion being slidably received within the first aperture and being drivably connected to the first piston; a second piston having a compression face opposed to the first piston compression face, the second piston being slidably disposed within the compression chamber; a second piston rod having proximate portion and a distal portion, the proximate portion being slidably received within the second aperture and drivable connected to the second piston; a first actuator attached to distal portion of the first piston rod; and a second actuator attached to the distal portion of the second piston rod. The piston rods define a translation axis extending through the compression chamber, and the first and second actuators are configured to drivably reciprocate the first and second pistons within the compression chamber along the translation axis.

In another embodiment of a reciprocating compressor, the compressor comprises a housing having an inner surface defining compression chamber, the housing having an aperture; a first piston having a compression face, the piston being slidably disposed within the compression chamber; a first piston rod having proximate portion and a distal portion, the proximate portion being slidably received within the aperture and being drivably connected to the first piston; a second piston having a compression face opposed to the first piston compression face, the second piston being slidably disposed within the compression chamber; a second piston rod having proximate portion and a distal portion, the proximate portion being slidably received within the first piston rod and drivable connected to the second piston; a first actuator attached to distal portion of the first piston rod; and a second actuator attached to the distal portion of the second piston rod. The first and second piston rods define a translation axis extending through the compression chamber, and the first and second actuators are configured to drivably reciprocate the first and second pistons within the compression chamber along the translation axis.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
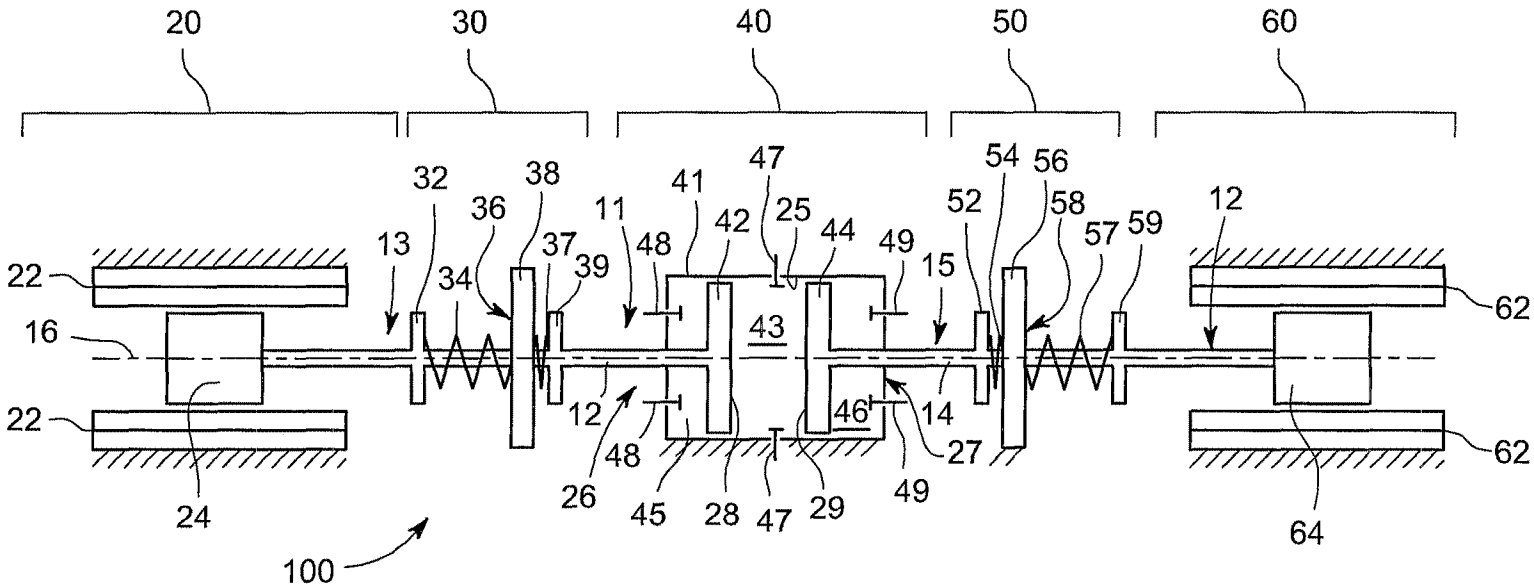
FIG. 1 show a cross-sectional, diagrammatical view of a phased piston reciprocating compressor of an embodiment of the present invention having a double electromagnetic actuator with resonance springs.
Figure 2:
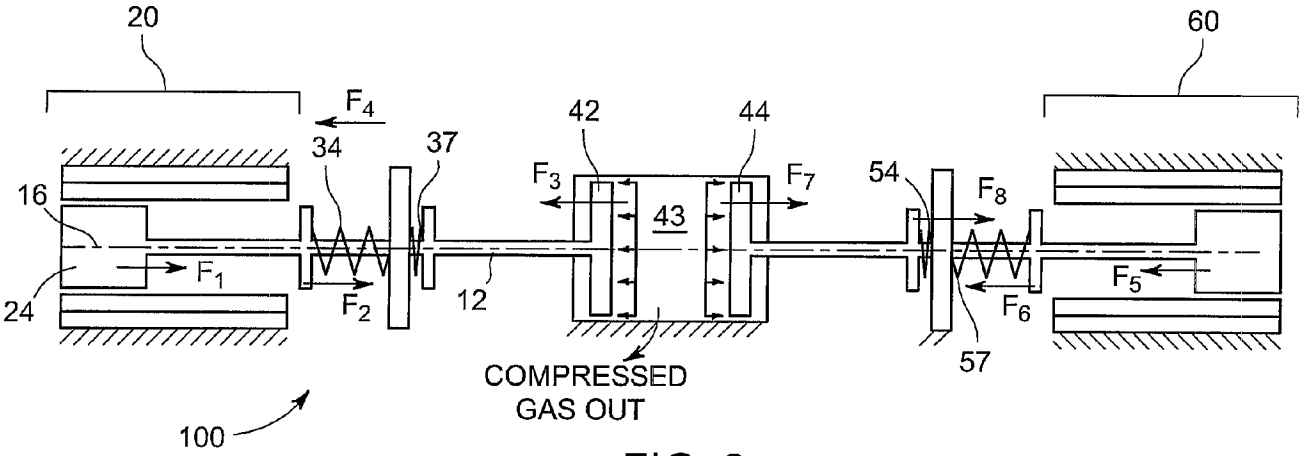
FIG. 2-3 are cross-sectional, diagrammatical views of the compressor of FIG. 1 illustrating the forces exerted on the reciprocating components during operation of the compressor.
Figure 3:
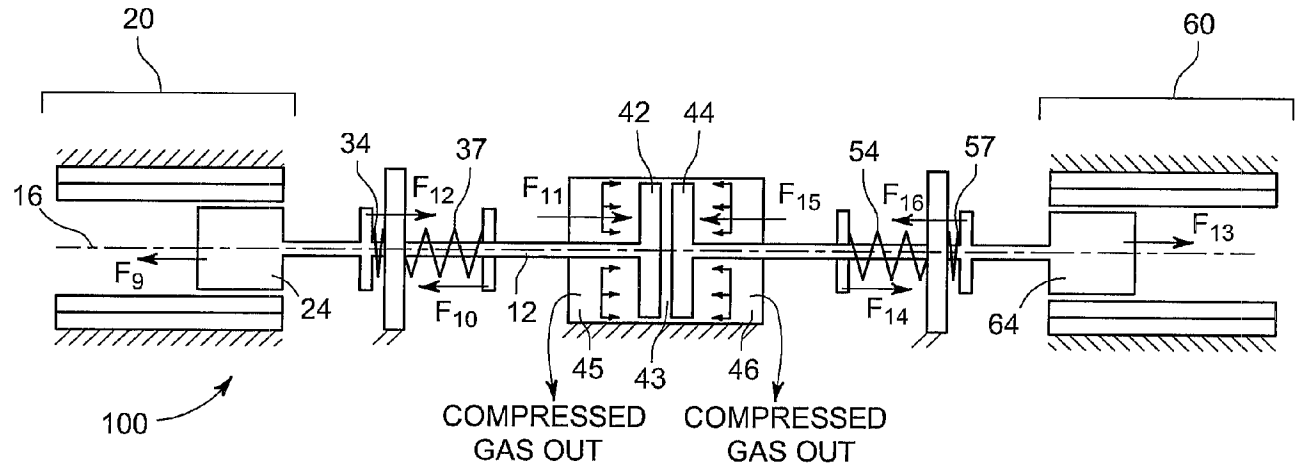

FIGS. 1-3 show a compressor having phased pistons driven by double electromagnetic actuators with resonance springs according to an embodiment of the present invention.

FIG. 1 shows a compressor 10 comprising a first drive assembly 20, a first accumulator assembly 30, a compression assembly 40, a second accumulator assembly 50, and a second drive assembly 60. A first piston rod 12 connects the first drive assembly 20, the first accumulator assembly 30, and the compression assembly 40. A second piston rod 14 connects the second drive assembly 60, the second accumulator assembly 50, and the compression assembly 40. The first piston rod 12 and the second piston rod 14 are arranged serially and substantially coaxially along an axis 16, the axis 16 extending through the center of the compression assembly 40.

The first drive assembly 20 mechanically communicates with the first accumulator assembly 30 and the compression assembly 40 through the first piston rod 12. The first accumulator assembly 30 mechanically communicates with the first drive assembly 20 and the compression assembly 40 through the first piston rod 12. The second drive assembly 60 mechanically communicates with the second accumulator assembly 50 and the compression assembly 40 through the second piston rod 14. The second accumulator assembly 50 mechanically communicates with the second drive assembly 60 and the compression assembly 40 through the second piston rod 14.

As shown in FIG. 1, the compression assembly 40 comprises a housing 41, a first compression piston 42, and a second compression piston 44. As more fully described below, a first compression piston 42 and a second compression piston 44 are axially disposed within the housing 41, and define least one fluidly isolated compression chamber. In one embodiment, the compression pistons (42,44) divide the housing volume into three chambers, each chamber being substantially fluidly isolated with respect to the other chambers.

The housing 41 further comprises a first aperture and a second aperture, each aperture being substantially aligned with axis 16, the apertures defining an orifice linking the interior of the housing with environment external to compression assembly 40. The first aperture slidably and sealably receives the first piston rod 12 along the axis 16, the first piston rod 12 extending into the housing 41 and connecting to the first compression piston 42. The second aperture slidably and sealably receives the second piston rod 14 along the axis 16, the second piston rod 14 extending into the housing 41 and connecting to the second compression piston 44.

The first piston 42 comprises a surface. The first piston surface comprises an edge, the edge being configured to slidably and sealably engage an inner surface of the housing. The first piston surface further comprises a proximal face, the proximal face being substantially orthogonal to the axis 16 and facing the second piston 44. The first piston surface further comprises a distal face opposite its proximal face, the rear face being substantially orthogonal to the axis 16. In an embodiment, the first piston rod 12 connects to the first compression piston 42 at the rear face of the first compression piston 42. As used herein, the term "proximal" refers to placement or movement toward the center of the compression assembly 40. As used herein, the term "distal" refers to placement or movement away from the center of the compression assembly 40.

The second piston 44 comprises a surface. The second piston surface comprises an edge, the edge being configured to slidably and sealably engage the housing inner surface. The second piston surface further comprises a proximal face, the proximal face being substantially orthogonal to the axis 16 and facing the proximal face of first piston 42. The second piston surface further comprises a distal face opposite its proximal face, the rear face being substantially orthogonal to the axis 16. In an embodiment, the second piston rod 14 connects to the second compression piston 44 at the distal surface of the second compression piston 44.

A portion of the housing inner surface, first piston proximal face, and second piston proximal face collectively define a central compression chamber 43. The central compression chamber 43 in turn is fluidly communicative a fluid source (not shown) and a fluid destination (also not shown) through an inlet/outlet valve 47. In an embodiment, a portion of the housing inner surface and the first piston distal face further define a first compression chamber 45. The first compression chamber 45 in turn is also fluidly communicative with the fluid source and the fluid destination through an inlet/outlet valve 48. In an embodiment, a portion of the housing inner surface and the second piston distal face further define a second compression chamber 46. The second compression chamber 46 in turn is fluidly communicative with the fluid source and the fluid destination through an inlet/outlet valve 49. In embodiments, one of the central compression chamber 43, the first compression chamber 45, and the second compression chamber 46 are substantially fluidly isolated from one another. As would be recognized by one of skill in the art in view of the disclosure and teachings herein, "fluid" refers materials comprising a liquid, a gas, or a comprising a combination of fluid and gas.

In embodiments, at least one of the valves (47,48,49) comprises a solenoid actuator (not shown). In an embodiment the solenoid actuator comprises an armature and a holding plate, wherein the holding plate is attached to one of the first and the second piston rods and the armature is fixed with respect to the one of the first and the second piston rods. In other embodiments, at least one of the valves (47,48,49) comprises a magnetic gearing actuator (not shown). Operatively, the valves (47,48,49) cooperate with movement of the pistons (42,44) to allow fluid to enter at least one compression chamber at a first pressure and exit the chamber at a second pressure. As would be understood by one of ordinary skill in the art in view of the disclosure and teachings herein, fluid communication between the chambers (43,45,46) and the fluid supply/destination may be accomplished by dedicated individual inlet and outlet valves as shown in FIG. 1-3, or through a single valve configured to selectively connect the chamber with a fluid source and fluid destination.

As further shown in FIG. 1, the first drive assembly drive 20 comprises a stator 22 and a core 24. The core 24 is attached to a distal end of the piston rod 12, and the stator 22 is fixed with respect to the core 24. Operatively, the stator 22 is configured to exert an electromagnetic force the core 24, thereby reciprocatedly driving the core 24 in the distal and proximal directions along the axis 16.

As also shown in FIG. 1, the second drive assembly drive 60 comprises a stator 62 and a core 64. The core 64 is attached to a distal end of the piston rod 14, and the stator 62 is fixed with respect to the core 64. Operatively, the stator 62 is configured to exert an electromagnetic force the core 64, thereby reciprocatedly driving the core 64 in the distal and proximal directions along the axis 16.

In an embodiment, the electromagnetic drive 20 is a linear motor wherein the stator 22 comprises a succession of adjacent coils selectively connectable to a power supply through a controller. When a selected coil is connected to the power supply, the coils exert an electromotive force on the coil, thereby driving the piston rod/compression piston axially along axis 16. When a group of adjacent coils is connected to the power supply, the electromagnetic force increases. When an adjacent coil in the direction of piston rod/compression assembly translation is added to the set of coils connected to the power supply, and an adjacent coil opposite to the direction of translation is removed from the set of coils connected to the power supply, the stator 22 maintains a constant level electromagnetic force on the core 24. As such, the controller is configured to dynamically select the group of coils connected to the power supply at any given time, and by energizing and de-energizing coils, configured to controllably displace the coil along the axis 16. In an embodiment of the invention, the electromagnetic drive comprises a commercially available linear motor.

As additionally shown in FIG. 1, the first accumulator 30 comprises a first flange 32, a first resilient member 34, a first post 38, a second resilient member 37, and a second flange 39. In an embodiment, one or both the flanges (32,39) may be defined by the piston rod 12. In other embodiments, one or both of the flanges may be constructed by attaching assemblies to the piston rod 12. The first post 38 comprises an aperture 36 that slidably receives the piston rod 12, and is fixed with respect to the piston rod 12. Each resilient member (34,37) comprises a first end and a second end. The first resilient member 34 attaches to the first flange 32 at the first end, and the first resilient member 34 attaches to the first post 38 at the second end. The second resilient member 37 attaches to the second flange 39 at the first end, and the second resilient member 34 attaches to the first post 38 at the second end.

As further shown in FIG. 1, the second accumulator 50 comprises a third flange 52, a third resilient member 54, a second post 56, a fourth resilient member 57, and a fourth flange 59. In an embodiment, one or both of the flanges (54,59) may be defined by the piston rod 14. In other embodiments, one or both of the flanges may be constructed by attaching assemblies to the piston rod 14. The second 56 comprises an aperture 58 that slidably receives the piston rod 14, and is fixed with respect to the piston rod 14. Each resilient member (54,57) comprises a first end and a second end. The third resilient member 54 attaches to the third flange 52 at the first end, and the third resilient member 54 attaches to the second post 56 at the second end. The fourth resilient member 57 attaches to the fourth flange 59 at the first end, and the fourth resilient member 57 attaches to the post 56 at the second end.

FIG. 2 and FIG. 3 show the forces exerted on piston rod/compression piston assemblies (12,42; 14,44) by the drive assemblies (20,60). As used herein, the phrase "top dead center" refers to a positional arrangement wherein a piston (42,44) disposed in the compression assembly 40 is substantially at its most distal point of translation along axis 16. As used herein, the phrase "bottom dead center" refers to a positional arrangement wherein a piston (42,44) disposed in the compression assembly 40 is substantially at its most proximal point of translation along axis 16.

FIG. 2 shows the forces exerted to drive first piston rod/compression piston assembly (12,42) in the proximal direction along axis 16. At the start of the stroke the assembly is substantially motionless, the piston 42 being substantially positioned at top dead center. Four forces are exerted on the assembly during proximal translation. First, the first drive assembly 20 accelerates the assembly by exerting the above-discussed electromotive force $F_1$ on the assembly, thereby driving the assembly in the proximal direction along axis 16. Second, at the start of the stroke and for a portion of the stroke, the deformed (elongated) first resilient member 34 returns to its normal shape, thereby exerting a proximally-oriented accelerating force $F_2$ on the assembly. Third, as the volume within central compression chamber 43 decreases, gas resident in the chamber exerts a distally-oriented force $F_3$ on the proximal face of the compression piston 42. Finally, at a point prior to the end of the stroke and continuing until the piston 42 reaches bottom dead center, the second resilient member 37 deforms (elongates), thereby exerting a distally-oriented decelerating force $F_4$ on the assembly.

FIG. 2 also shows the forces exerted to drive second piston rod/compression piston assembly (14,44) in the proximal direction along axis 16. At the start of the stroke the assembly is substantially motionless, the piston 44 being substantially positioned at top dead center. As described above, four forces are exerted on the assembly during proximal translation. First, the second drive assembly 60 accelerates the assembly by exerting the above-discussed electromotive force $F_5$ on the assembly, thereby driving the assembly in the proximal direction along axis 16. Second, at the start of the stroke and for a portion of the stroke, the deformed (elongated) third resilient member 57 returns to its normal shape, thereby exerting a proximally-oriented accelerating force $F_6$ on the assembly. Third, as the volume within the central compression chamber 43 decreases, gas resident in the chamber exerts a distally-oriented force $F_7$ on the proximal face of the compression piston 44. Finally, at a point prior to the end of the stroke and continuing until the piston 44 reaches bottom dead center, the fourth resilient member 54 deforms (elongates), thereby exerting a distally-oriented decelerating force $F_8$ on the assembly.

FIG. 3 shows the forces exerted to drive first piston rod/compression piston assembly (12,42) in the distal direction along axis 16. At the start of the stroke the assembly is substantially motionless, the piston 42 being substantially positioned at bottom dead center. Four forces are exerted on the assembly during distal translation. First, the first drive assembly 20 accelerates the assembly by exerting the above-discussed electromotive force as a force $F_9$ on the assembly, thereby driving the assembly in the distal direction along axis 16. Second, at the start of the stroke and for a portion of the stroke, the deformed (elongated) second resilient member 37 returns to its normal shape, thereby exerting a distally-oriented accelerating force $F_{10}$ on the assembly. Third, as the volume within first compression chamber 45 decreases, gas resident in the chamber exerts a proximally-oriented force $F_{11}$ on the distal face of the first compression piston 42. Finally, at a point prior to the end of the stroke and continuing until the piston 42 reaches top dead center, the first resilient member 34 deforms (elongates), thereby exerting a proximally-oriented decelerating force $F_{12}$ on the assembly.

FIG. 3 also shows the forces exerted to drive second piston rod/compression piston assembly (14,44) in the distal direction along axis 16. At the start of the stroke the assembly is substantially motionless, the piston 44 being substantially positioned at bottom dead center. As described above, four forces are exerted on the assembly during distal translation. First, the second drive assembly 60 accelerates the assembly by exerting the above-discussed electromotive force $F_{13}$ on the assembly, thereby driving the assembly in the distal direction along axis 16. Second, at the start of the stroke and for a portion of the stroke, the deformed (elongated) third resilient member 54 returns to its normal shape, thereby exerting a distally-oriented accelerating force $F_{14}$ on the assembly. Third, as the volume within the second compression chamber 46 decreases, gas resident in the chamber exerts a proximally-oriented force $F_{15}$ on the distal face of the compression piston 44. Finally, at a point prior to the end of the stroke and continuing until the piston 44 reaches top dead center, the fourth resilient member 57 deforms (elongates), thereby exerting a distally-oriented decelerating force $F_{16}$ on the assembly.

During the stroke, the sum of the forces dictates the rate at which the assembly accelerates and decelerates during its translation along axis 16. When the assembly is accelerating, the inertia of the assembly increases. When the assembly is decelerating, the inertia of the assembly decreases. When the assembly travels at a fixed velocity, the inertia of the assembly is constant. Hence, at the beginning of the stroke, relaxation of the first resilient member accelerates the assembly, thereby increasing the inertia resident in the assembly. During a point of travel the second resilient member begins to deform, decelerating the assembly, thereby decreasing the inertia resident in the assembly. Collectively, the resilient members have the technical effect of storing the inertial energy resident in the assembly during a first stroke, and imparting that stored energy to the assembly during a subsequent stroke, thereby conserving the energy present in the piston rod/compression piston assemblies (12,42;14,44) during reciprocation.

As would be readily apparent to one of ordinary skill in the art in view of the disclosure and teachings herein, the configuration of the resilient member pairs described above may be altered to change the timing at which the associated forces are applied. For example, it is within the scope of the present invention for the illustrated pairs of resilient members (34,37;54,57) to have different spring constants. Alternatively, the distance over which the resilient member applies force may be different within a pair of resilient members (34,37;54,57). Finally, it is within the scope of the present invention for the a single resilient member to perform the above-discussed functions, for example to start the stroke elongated in a distal direction at the start of the stroke, relax during the course of the stroke, and deform in the proximal direction during a terminal portion of the stroke.

In an embodiment, the resilient member comprises a resonant spring having a spring constant, a resonant frequency, and harmonics of the spring resonant frequency. In the illustrated embodiment, the resonant spring 34 is configured to be deformed as the piston approaches top dead center by the distal translation of first flange 32 with respect to first post 38, thereby stretching the resonant spring, causing the spring to absorb energy, the spring further decelerating the piston rod/compression piston assembly (12,42) as it approaches top dead center. In the embodiment, the stretched resonant spring 34 returns to its normal shape during the subsequent stroke, thereby accelerating the piston rod/compression piston assembly (12,42) proximally, thereby accumulating inertial energy resident in the assembly during a first distal stroke along axis 16, and returning energy to the assembly during a second proximal stroke along axis 16 by accelerating the assembly proximally along axis 16.

In certain embodiments, the spring is a resonant spring configured to absorb more energy when the frequency of its oscillations (reciprocations) matches the natural frequency of the resonant spring, or a harmonic thereof. For example, when the reciprocating rate of the piston rod 12/compression piston 42 substantially matches the natural frequency of resonant spring 34, the above-described cyclic spring deformations maximize energy accumulated and applied by the spring in successive reciprocations. In such embodiments, operating the compressor 10 such that the piston rod/compression piston assembly reciprocates at a rate substantially matching the spring resonant frequency or a harmonic thereof minimizes the drive force requirement.

Embodiments of the compressor may run in a partially loaded state. In one mode, the load on the distal face of piston 42 may be modulated by controlling the timing of fluid communication between the chamber 45 and the fluid source/destination through selective operation of valve 48. For example, piston 42 may be partially unloaded by operating valve 48 such that the pressure difference between fluid entering and leaving chamber 45 is reduced, or substantially minimized, during a portion of piston movement. Similarly, the load on the distal face of piston 44 may be modulated by controlling the timing of fluid communication between the chamber 46 and the fluid source/destination through selective operation of valve 49. For example, piston 44 may be partially unloaded by operating valve 49 such that the pressure difference between fluid entering and leaving chamber 46 is reduced, or substantially minimized, during a portion of piston movement. In another mode, the load on proximal faces of the pistons (42,44) may be modulated by controlling the timing of fluid communication between chamber 43 and the fluid source/destination through operation of valve 47. For example, the pistons (42,44) may be partially unloaded by operating valve 47 such that the pressure difference between fluid entering and leaving chamber 43 is reduced, or substantially minimized, during a portion of piston movement. Such modes of operation allow for flexible operation, such as periods where fluid demand changes, such as when natural gas demand changes in a natural gas distribution network.

In an embodiment the compressor is a variable capacity compressor. For example, the controller may be configured to vary piston phase, and thereby compressor capacity, by being programmed with set of instructions recorded on a non-transitory, machine-readable media that cause the controller to (i) receive a compressor phase setting, the phase setting comprising a piston offset between 0 degrees and 180 degrees; (ii) select the group of coils from the plurality of coils necessary to connect to the power supply during a stroke of the piston rod/compression piston to define respective stroke lengths; (iii) define the time that each selected coil must be connected to the power supply, define period of time in which the coil be connected to the power supply during the respective stroke, and define the time at which point the coil be disconnected from the power supply during the respective stroke; and (iv) selectively connect the identified coils to the power supply at the defined time, allow the selected coils to remain connected to the power supply for the defined period of time, and selectively disconnect the identified coils at the defined time, to drive the piston rod/compression piston assemblies. In an embodiment, the controller may also be configured to receive a stroke length setting for use in selecting the coils and defining the connection time, connection duration, and disconnect time.

Figure 4:
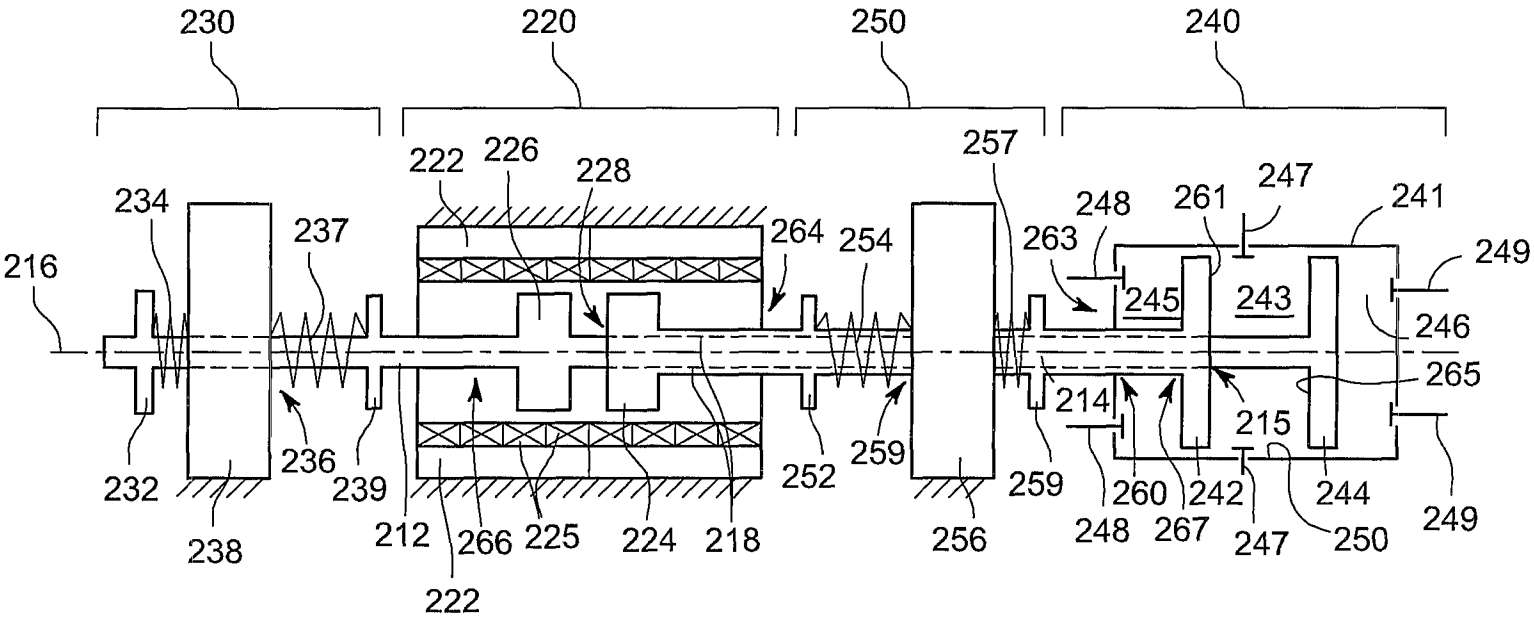
FIG. 4 show a cross-sectional, diagrammatical view of a phased piston reciprocating compressor of an embodiment of the present invention having coaxially nested piston rods and a single electromagnetic actuator with resonance springs.
Figure 5:
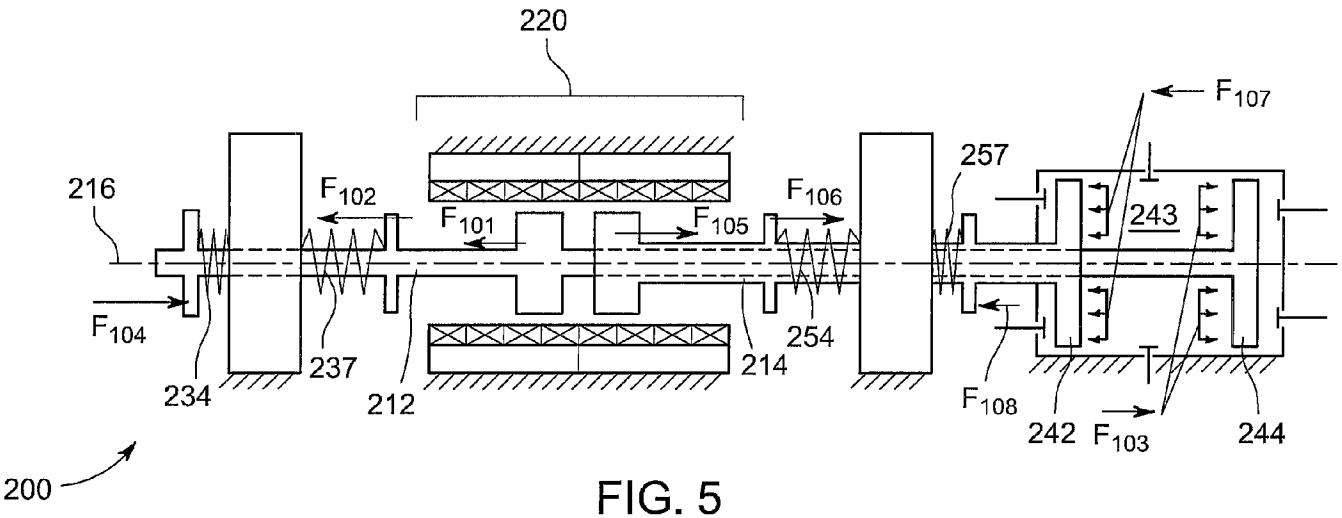
FIG. 5-6 are cross-sectional, diagrammatical views of the compressor of FIG. 4 illustrating the forces exerted on the reciprocating components during operation of the compressor.
Figure 6:
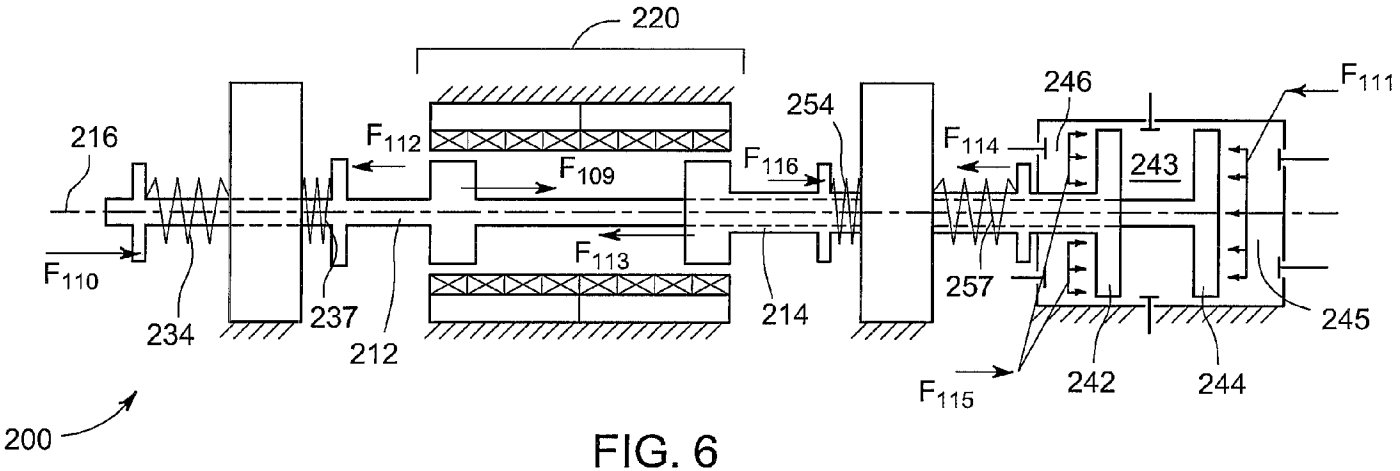

FIGS. 4-6 show a compressor having phased pistons driven by a single electromagnetic actuator with resonance springs according to an embodiment of the present invention.

FIG. 4 shows a compressor 200 comprising a drive assembly 220, a first accumulator assembly 230, a compression assembly 240, and a second accumulator assembly 250. A first piston rod 212 connects the drive assembly 220, the first accumulator assembly 230, and the compression assembly 240. A second piston rod 214 connects the drive assembly 220, the second accumulator assembly 250, and the compression assembly 240.

The second piston rod 214 is hollow, comprising a corridor (not shown) having a distal opening 228 one its distal end and having a proximal opening 215 on its proximal end. The second piston rod is adapted to slidably and sealably receive a portion of the first piston rod 212 along its axial length, the first and second piston rods being coaxially aligned along ax axis 216. As shown in FIG. 4, dashed lines 218 indicate a portion of the first piston rod 212 received within the second piston rod 214. Operatively, the piston rods are configured such that the piston rods (212,214) may translate independently with respect to the other along the axis 216.

The drive assembly 220 mechanically communicates with the first accumulator assembly 230 and the compression assembly 240 through the first piston rod 212. The first accumulator assembly 230 mechanically communicates with the drive assembly 220 and the compression assembly 240 through the first piston rod 212. The drive assembly 220 also mechanically communicates with the second accumulator assembly 250 and the compression assembly 240 through the second piston rod 214. The second accumulator assembly 250 mechanically communicates with the drive assembly 220 and the compression assembly 240 through the second piston rod 214.

As shown in FIG. 4, the compression assembly 240 comprises a housing 241, a first compression piston 242, and a second compression piston 244. A first compression piston 244 and a second compression piston 242 are axially disposed within the housing 241, and define least one fluidly isolated compression chamber. In the embodiment shown in FIG. 4, the compression pistons (242,244) divide the housing volume into three chambers, each chamber being substantially fluidly isolated with respect to the other chambers.

The housing 241 further comprises an aperture substantially aligned with axis 216, the aperture defining an orifice linking the interior of the housing with environment external to compression assembly 240. The first aperture slidably and sealably receives the second piston rod 214 along the axis 216, the second piston rod 214 extending into the housing 241 and connecting to the second compression piston 242.

The second compression piston 242 comprises a surface. The second compression piston surface comprises an edge, the edge being configured to slidably and sealably engage an inner surface of the housing 241. The first piston surface further comprises a proximal face, the proximal face being substantially orthogonal to the axis 216. The first piston proximal face further comprises the aperture 215, the first piston rod 212 extending through the aperture 215 and attaching to the first compression piston 244. The first compression piston surface further comprises a distal face opposite the proximal face, the rear face being substantially orthogonal to the axis 216. In an embodiment, the second piston rod 214 connects to the second compression piston 242 at the rear face of the second compression piston 242.

The first compression piston 244 comprises a surface. The first compression piston surface comprises an edge, the edge being configured to slidably and sealably engage the housing inner surface. The first compression piston surface further comprises a proximal face, the proximal face being substantially orthogonal to the axis 216 and facing the proximal face of second compression piston 242. The first piston surface further comprises a distal face opposite its proximal face, the rear face being substantially orthogonal to the axis 216. In the embodiment shown in FIG. 4, the first piston rod 212 connects to the first compression piston 244 at its proximal surface.

A portion of the housing inner surface, first piston proximal face, and second piston proximal face collectively define a central compression chamber 243. The central compression chamber 243 in turn is fluidly communicative a fluid source (not shown) and a fluid destination (also not shown) through an inlet/outlet valve 247. In an embodiment, a portion of the housing inner surface and the first piston distal face further define a first compression chamber 245. The first compression chamber 245 in turn is also fluidly communicative with the fluid source and the fluid destination through an inlet/outlet valve 248. In an embodiment, a portion of the housing inner surface and the second piston distal face further define a second compression chamber 246. The second compression chamber 246 in turn is fluidly communicative with the fluid source and the fluid destination through an inlet/outlet valve 249. In embodiments, one of the central compression chamber 243, the first compression chamber 245, and the second compression chamber 246 are substantially fluidly isolated from one another.

In embodiments, at least one of the valves (247,248,249) comprises a solenoid actuator (not shown). In an embodiment, the solenoid actuator comprises an armature and a holding plate, wherein the holding plate is attached to one of the first and the second piston rods, and wherein the armature is fixed with respect to the one of the first and second piston rods. In other embodiments, at least one of the valves (247,248,249) comprises a magnetic gearing actuator (not shown). Operatively, the valves (247,248,249) cooperate with movement of the pistons (242,244) to allow fluid to enter at least one compression chamber at a first pressure and exit the chamber at a second pressure. As would be understood by one of ordinary skill in the art in view of the disclosure and teachings herein, fluid communication between the chambers (243,245,246) and the fluid supply/destination may be accomplished by dedicated individual inlet and outlet valves as shown in FIG. 4-6, or through a single valve configured to selectively connect the chamber with a fluid source and fluid destination.

As further shown in FIG. 4, the drive assembly drive 220 comprises a stator 222, first core 226, and a second core 228. The first core 226 is attached to the first piston rod 212, the second core 228 is attached to the distal portion of the second piston rod 214, and the stator 222 is fixed with respect to the cores (226,228). Operatively, the stator 222 is configured to exert an electromagnetic force the cores (226, 228), thereby reciprocatedly driving the cores (226,228) in the distal and proximal directions along the axis 216. In embodiment of the invention, the stator is configured to independently drive the cores (226,228) with respect to one another.

In an embodiment, the drive assembly 220 comprises a linear motor wherein the stator 222 comprises a plurality of coils 225 selectively connectable to a power supply (not shown) through a controller (not shown). When an individual coil from the plurality of coils 2251 is connected to the power supply, the coils exert an electromotive force on the cores (226,228), thereby driving the piston rod/compression piston attached to the respective core axially along axis w16. When a coil is added to the set of coils connected to the power supply, the electromagnetic force increases. When a coil is removed to the set of coils connected to the power supply, the electromagnetic force decreases. When an adjacent coil in the direction of piston rod/compression assembly translation is added to the set of coils connected to the power supply, and an adjacent coil opposite to the direction of translation is removed from the set of coils connected to the power supply, the stator 222 maintains a constant electromagnetic force on the respective core 24—the electromagnetic force in effect following the core as is translates along the axis. In one embodiment of the invention, the electromagnetic drive comprises a commercially available linear motor.

As additionally shown in FIG. 4, the first accumulator 230 comprises a first flange 232, a first resilient member 234, a first post 238, a second resilient member 237, and a second flange 239. In an embodiment, one or both the flanges (232,239) may be defined by the first piston rod 212. In other embodiments, one or both of the flanges may be constructed by attaching assemblies to the first piston rod 212. The first post 238 comprises an aperture 236 that slidably receives the first piston rod 212, and the post 238 being fixed with respect to the piston rod 212. Each resilient member (234,237) comprises a first end and a second end. The first resilient member 234 attaches to the first flange 232 at its first end, and the first resilient member 234 attaches to the first post 238 at its second end. The second resilient member 237 attaches to the second flange 239 at its first end, and the second resilient member 234 attaches to the first post 238 at its second end.

As shown in FIG. 4, the second accumulator 250 comprises a third flange 252, a third resilient member 254, a second post 256, a fourth resilient member 257, and a fourth flange 259. In an embodiment, one or both the flanges (254,259) may be defined by the second piston rod 214. In other embodiments, one or both of the flanges may be constructed by attaching assemblies to the second piston rod 214. The second post 256 comprises an aperture 258 that slidably receives the second piston rod 214, and is fixed with respect to the second piston rod 214. Each resilient member (254,257) comprises a first end and a second end. The third resilient member 254 attaches to the third flange 252 at its first end, and the third resilient member 254 attaches to the second post 256 at its second end. The fourth resilient member 257 attaches to the fourth flange 259 at its first end, and the fourth resilient member 257 attaches to the post 256 at its second end.

FIG. 5 and FIG. 6 show the forces exerted on piston rod/compression piston assemblies (212,242; 214,244) by the drive assembly (220) in compressor 200.

FIG. 5 shows the forces exerted to drive first piston rod/compression piston assembly (212,244) to drive the piston 244 in the proximal direction along axis 216, as would be applied during a first reciprocation of compressor 200. At the start of the stroke the assembly is substantially motionless, the piston 242 being substantially positioned at top dead center. Four forces are exerted on the assembly during proximal translation. First, the drive assembly 220 accelerates the assembly by exerting the above-discussed, distally-oriented, electromotive force $F_{101}$ on the assembly, thereby driving the assembly in the distal direction along axis 216. Second, at the start of the stroke and for a portion of the stroke, the deformed (elongated) first resilient member 237 returns to its normal shape, thereby exerting a distally-oriented accelerating force $F_{102}$ on the assembly. Third, as the volume within central compression chamber 243 decreases, gas resident in the chamber exerts an opposing force $F_{103}$ on the proximal face of the compression piston 244. Finally, at a point prior to the end of the stroke and continuing until the piston 244 reaches bottom dead center, the second resilient member 3234 deforms (elongates), thereby exerting an opposing force $F_{104}$ on the assembly, thereby decelerating the assembly as it approaches its bottom dead center position.

FIG. 5 also shows the forces exerted to drive second piston rod/compression piston assembly (214,242) to drive the piston 242 in the proximal direction along axis 216, as would be applied during a first reciprocation of compressor 200. At the start of the stroke the assembly is substantially motionless, the piston 242 being substantially positioned at top dead center. Four forces are exerted on the assembly during second piston proximal translation. First, the drive assembly 220 accelerates the assembly by exerting the above-discussed, proximally oriented, electromotive force $F_{105}$ on the assembly, thereby driving the assembly in the proximal direction along axis 216. Second, at the start of the stroke and for a portion of the stroke, the deformed (elongated) third resilient member 254 returns to its normal shape, thereby exerting a proximally-oriented accelerating force $F_{106}$ on the assembly. Third, as the volume within the central compression chamber 243 decreases, gas resident in the chamber exerts an opposing force $F_{107}$ on the proximal face of second compression piston 242. Finally, at a point prior to the end of the stroke and continuing until the piston 242 reaches bottom dead center, the fourth resilient member 257 deforms (elongates), thereby exerting an additional opposing force $F_{108}$ on the assembly thereby decelerating the assembly as it approaches its bottom dead center position.

Operatively, the forces at play sum together, and the resultant force causes piston movement. In an embodiment, the forces applied by the resilient members are applied for only a portion of the stroke and complement the drive assembly force. For example, one resilient member of an accumulator begins the stroke in an elongated state, thereby having the technical effect of reducing the force otherwise required of the drive assembly by applying additional force at the start of the stroke. Similarly, the complementary resilient member of the accumulator begins the stroke in a normal state, and becomes elongated towards the end of the stroke, thereby having the technical effect of decelerating the assembly and storing inertial energy for the subsequent reciprocation of the assembly.

FIG. 6 shows the forces exerted to drive first piston rod/compression piston assembly (212,244) in the distal direction along axis 216, as would be applied during a second reciprocation of compressor 200. At the start of the stroke the assembly is substantially motionless, the first compression piston 244 being substantially positioned at bottom dead center. Four forces are exerted on the assembly during distal piston translation. First, the drive assembly 220 accelerates the assembly by exerting a proximally-oriented electromotive force $F_{109}$ on the assembly, thereby driving the piston in the distal direction along axis 216. Second, at the start of the stroke and for a portion of the stroke, the deformed (elongated) first resilient member 234 returns to its normal shape, thereby exerting a proximally-oriented accelerating force $F_{110}$ on the assembly. Third, as the volume within first compression chamber 245 decreases, gas resident in the chamber exerts an opposing force $F_{111}$ on the distal face of the first compression piston 244. Finally, at a point prior to the end of the stroke and continuing until the piston 42 substantially reaches the top dead center position, the second resilient member 237 deforms (elongates), thereby exerting an opposing force $F_{112}$ on the assembly, thereby decelerating the assembly as it approaches its top dead center position.

FIG. 6 also shows the forces exerted to drive second piston rod/compression piston assembly (214,242) in the distal direction along axis 216, as would be applied during a second reciprocation of compressor 200. At the start of the stroke the assembly is substantially motionless, the second compression piston 242 being substantially positioned at bottom dead center. Four forces are exerted on the assembly during distal translation of the second compression piston 242. First, the drive assembly 220 accelerates the assembly by exerting the above-discussed electromotive force $F_{113}$ on the assembly, thereby driving the piston 242 in the distal direction along axis 216. Second, at the start of the stroke and for a portion of the stroke, the deformed (elongated) fourth resilient member 257 returns to its normal shape, thereby exerting a distally-oriented accelerating force $F_{114}$ on the assembly. Third, as the volume within the second compression chamber 246 decreases, gas resident in the chamber exerts an opposing force $F_{115}$ on the distal face of the compression piston 242. Finally, at a point prior to the end of the stroke and continuing until the second compression piston 242 reaches its top dead center position, the third resilient member 254 deforms (elongates), thereby exerting an opposing force $F_{116}$ on the assembly, thereby decelerating the assembly as it approaches its top dead center position.

During the stroke, the sum of the forces dictates the rate at which the assembly accelerates and decelerates during its translation along axis 216. When the assembly is accelerating, the inertia of the assembly increases. When the assembly is decelerating, the inertia of the assembly decreases. When the assembly travels at a fixed velocity, the inertia of the assembly is constant. Hence, at the beginning of the stroke, relaxation of the first resilient member accelerates the assembly, thereby increasing the inertia resident in the assembly. During a point of travel the second resilient member begins to deform, decelerating the assembly, thereby decreasing the inertia resident in the assembly. Collectively, the resilient members have the technical effect of storing the inertial energy resident in the assembly during a first stroke, and imparting that stored energy to the assembly during a subsequent stroke, thereby conserving the energy present in the piston rod/compression piston assemblies (212,244;214,242) during reciprocation.

In an embodiment, the resilient member comprises a resonant spring having a spring constant, a resonant frequency, and harmonics of the spring resonant frequency. In the illustrated embodiment, the resonant spring 34 is configured to be deformed as the piston approaches top dead center by the distal translation of first flange 32 with respect to first post 38, thereby stretching the resonant spring, causing the spring to absorb energy, the spring further decelerating the piston rod/compression piston assembly (12,42) as it approaches top dead center. In the embodiment, the stretched resonant spring 34 returns to its normal shape during the subsequent stroke, thereby accelerating the piston rod/compression piston assembly (12,42) proximally, thereby accumulating inertial energy resident in the assembly during a first distal stroke along axis 16, and returning energy to the assembly during a second proximal stroke along axis 16 by accelerating the assembly proximally along axis 16.

In certain embodiments, the spring is a resonant spring configured to absorb more energy when the frequency of its oscillations (reciprocations) matches the natural frequency of the resonant spring, or a harmonic thereof. For example, when the reciprocating rate of the piston rod 12/compression piston 42 substantially matches the natural frequency of resonant spring 34, the above-described cyclic spring deformations maximize energy accumulated and applied by the spring in successive reciprocations. In such embodiments, operating the compressor 10 such that the piston rod/compression piston assembly reciprocates at a rate substantially matching the spring resonant frequency or a harmonic thereof minimizes the drive force requirement.

Embodiments of the compressor may run in a partially loaded state. In one mode, the load on the distal face of piston 242 may be modulated by controlling the timing of fluid communication between the chamber 245 and the fluid source/destination through selective operation of valve 248. For example, piston 242 may be partially unloaded by operating valve 248 such that the pressure difference between fluid entering and leaving chamber 245 is reduced, or substantially minimized, during a portion of piston movement. Similarly, the load on the distal face of piston 244 may be modulated by controlling the timing of fluid communication between the chamber 246 and the fluid source/destination through selective operation of valve 249. For example, piston 244 may be partially unloaded by operating valve 249 such that the pressure difference between fluid entering and leaving chamber 246 is reduced, or substantially minimized, during a portion of piston movement. In another mode, the load on proximal faces of the pistons (242,244) may be modulated by controlling the timing of fluid communication between chamber 243 and the fluid source/destination through operation of valve 247. For example, the pistons (242,244) may be partially unloaded by operating valve 247 such that the pressure difference between fluid entering and leaving chamber 243 is reduced, or substantially minimized, during a portion of piston movement. Such modes of operation allow for flexible operation, such as periods where fluid demand changes, such as when natural gas demand changes in a natural gas distribution network.

In an embodiment the compressor is a variable capacity compressor. For example, the controller may be configured to vary piston phase, and thereby compressor capacity, by being programmed with set of instructions recorded on a non-transitory, machine-readable media that cause the controller to (i) receive a compressor phase setting, the phase setting comprising a piston offset between 0 degrees and 180 degrees; (ii) select the group of coils from the plurality of coils necessary to connect to the power supply during a stroke of the piston rod/compression piston to define respective stroke lengths; (iii) define the time that each selected coil must be connected to the power supply, define period of time in which the coil be connected to the power supply during the respective stroke, and define the time at which point the coil be disconnected from the power supply during the respective stroke; and (iv) selectively connect the identified coils to the power supply at the defined time, allow the selected coils to remain connected to the power supply for the defined period of time, and selectively disconnect the identified coils at the defined time, to drive the piston rod/compression piston assemblies. In an embodiment, the controller may also be configured to receive a stroke length setting for use in selecting the coils and defining the connection time, connection duration, and disconnect time.

In an embodiment, the nested piston rods (212,214) of compressor 200 result in a smaller, more compact compressor and allow for the compressor to be constructed from a single drive assembly. As a result, the overall dimensions of the machine are smaller, reducing the size of the facility required to house the compressor.

As would be readily apparent to one of ordinary skill in the art in view of the disclosure and teachings herein, the configuration of the resilient member pairs described above may be altered to change the timing at which the associated forces are applied. For example, it is within the scope of the present invention for the illustrated complementary resilient members (234,237;254,257) to have different spring constants. Alternatively, the distance over which the resilient member applies force may be different between complementary resilient members (234,237;254,257). Finally, it is within the scope of the present invention for the a single resilient member to perform the above-discussed functions, for example to start the stroke elongated in a distal direction at the start of the stroke, relax during the course of the stroke, and deform in the proximal direction during a terminal portion of the stroke.

According to an embodiment, a capacitor having a first conductor fixed and a second conductor attached to either the first or the second piston rod are separated by a dielectric (e.g. air); in this way, the capacitor has moving plates (to be precise one plate moves with respect to the other plate) and thus has a variable capacitance. According to a variant of this embodiment, the dielectric-occupied distance between the two conductive plates varies with translation of the piston rods. The first and second conductors may be charged once-for-all and left isolated during operation of the compressor, or may be charged differently and left isolated during distinct operating periods of the compressors, or may be permanently connected to a constant voltage generator during operation of the compressor, or may be permanently connected to a variable voltage generator during operation of the compressor (typically the voltage of the generator is varied slowly with respect to the oscillation period of the translatable assembly). Such an accumulator stores a changeable electric charge corresponding to movement of the piston rods, the capacitor thereby banking the inertial energy of the piston rods and being configured to supply the charge to power a subsequent translation of the piston rods. The use of one or more capacitor may be combined with the use of one ore more springs that may have a constant or a variable spring constant.

It is worth noting that the springs of the embodiments of the present invention may have a spring constant that is constant with respect to time and space which corresponds to the most common case for helical springs; alternatively, the spring constant may vary in time and/or in position, in particular along its length (i.e. it depends on the degree of compression of the spring).

According to an embodiment, a variable accumulator is provided being configured to vary compressor capacity by increasing stroke and maintaining actuation time, thereby allowing for magnet position to be optimized. In an illustrative manner, the accumulator comprises a resilient member having a plurality of selectable parallel springs. The number of springs used in a stroke can change, thereby altering the spring constant, thereby varying the stroke length and optimizing the magnet position.

More in general, such accumulator may comprise a spring assembly having a first end coupled to either the first or the second piston rod and a second end fixed with respect to either the first or the second piston rod. A spring assembly may comprise a plurality of springs and the spring constant of this spring assembly may be adjustable; the springs may have different spring constant and be arranged in parallel so to be selectively effective. Alternatively, a spring assembly may comprise a plurality of springs having different lengths and be arranged in parallel so to have different effective strokes (i.e. in a first displacement range of the translatable assembly a first set of springs are active on the translatable assembly, in a second displacement range a second set of springs are active, in a third displacement range a third set of springs are active, . . . ) The expression "arranged in parallel" is to be interpreted from the functional point of view; in fact, the axes of the springs may be parallel to each other (even coincident as a limit case) or inclined to each other.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A reciprocating compressor comprising:

a housing comprising:

an inner surface defining at least one compression chamber, a first aperture, and a second aperture;

a first piston comprising at least one first piston compression face, the first piston being slidably disposed within the compression chamber;

a first piston rod comprising a first proximate portion and a first distal portion, the first proximate portion being slidably received within the first aperture, the first piston rod being drivably connected to the first piston;

a second piston comprising at least one second piston compression face opposed to the first piston compression face, the second piston being slidably disposed within the compression chamber;

a second piston rod comprising a second proximate portion and a second distal portion, the second proximate portion being slidably received within the second aperture, the second piston rod being drivably connected to the second piston;

a first actuator attached to the first distal portion of the first piston rod; and a second actuator attached to the second distal portion of the second piston rod, wherein the first and the second piston rods define a translation axis extending through the compression chamber, wherein the first and the second actuators are configured to drivably reciprocate the first and the second pistons within the compression chamber along the translation axis, wherein the first and the second actuators comprises a force generator and a force accumulator disposed between the force generator and the distal portion of the piston rod, and wherein the force accumulator comprises at least one capacitor having a first conductive material attached to one of the first and the second piston rods and a second conductive material fixed with respect to one of the first and the second piston rods, wherein the at least one capacitor has a variable capacitance.

2. The reciprocating compressor of claim 1, wherein the force accumulator comprises a spring assembly comprising:

a first end attached to one of the first and the second piston rods;

a second end fixed with respect to one of the first and the second piston rods; and a plurality of springs, wherein a spring constant of the spring assembly is adjustable.

3. The reciprocating compressor of claim 2, wherein at least one spring of the plurality of springs has a spring constant variable along its length.

4. The reciprocating compressor of claim 2, wherein the plurality of springs have different lengths and are arranged in parallel so to have different effective strokes.

5. The reciprocating compressor of claim 2, wherein the plurality of springs have different spring constants and are arranged in parallel so to be selectively effective.

6. The reciprocating compressor of claim 2, wherein the one of the first and the second piston rods is configured to reciprocate at a frequency substantially matched to one of a resonance frequency at least one spring of the plurality of springs and a harmonic of the resonance frequency of the spring.

7. The reciprocating compressor of claim 1, wherein at least one actuator of the first and the second actuators comprises a solenoid actuator comprising an armature and a holding plate, wherein the holding plate is attached to one of the first and the second piston rods, and wherein the armature is fixed with respect to the one of the first and the second piston rods.

8. The reciprocating compressor of claim 7, wherein the solenoid actuator is configured to translate along the translation axis.

9. The reciprocating compressor of claim 1, wherein the at least one actuator comprises an linear motor comprising a stator and a core, wherein the core is attached to one of the first and the second piston rods, and wherein the stator is fixed with respect to the one of the first and the second piston rods.

* * * * *